United States Patent [19]

Whiteman

[11] Patent Number: 4,793,397

[45] Date of Patent: Dec. 27, 1988

[54] DOOR AND HINGE CONSTRUCTION FOR OVERHEAD DOORS

[75] Inventor: Paul L. Whiteman, East Earl, Pa.

[73] Assignee: Morgan Corporation, Morgantown, Pa.

[21] Appl. No.: 26,787

[22] Filed: Mar. 17, 1987

Related U.S. Application Data

[63] Continuation of Ser. No. 824,417, Jan. 31, 1986, abandoned.

[51] Int. Cl.[4] ..... E05D 15/16

[52] U.S. Cl. ..... 160/201; 160/229.1

[58] Field of Search ..... 160/201, 229 R, 232, 160/40

[56] References Cited

U.S. PATENT DOCUMENTS

| | | | |
|---|---|---|---|
| 2,311,470 | 2/1943 | Ritter | 160/201 X |
| 2,831,537 | 4/1958 | Ritter | 160/201 |
| 2,951,533 | 9/1960 | Lucas et al. | 160/201 X |
| 3,148,724 | 9/1964 | Chieger et al. | 160/201 X |
| 3,302,690 | 2/1967 | Hurd | 160/201 X |
| 3,815,657 | 6/1974 | Malek et al. | 160/201 X |
| 3,894,571 | 7/1975 | Hinchliff | 160/201 |
| 4,205,713 | 6/1980 | Galbreath | 160/201 |
| 4,532,973 | 8/1985 | DeFalco | 160/201 X |

*Primary Examiner*—Ramon S. Britts
*Assistant Examiner*—David M. Purol
*Attorney, Agent, or Firm*—Elliot M. Olstein; John N. Bain; John G. Gilfillan

[57] ABSTRACT

Door and hinge construction for overhead doors is disclosed for use with sliding door panels, which includes combination hinge and roller housings engaged with and located at each side of the door panels, serving to retain the panels together, and which carry rollers which ride in tracks outside the door panel, with hinge and seal members engaged with the panels between the combination housings providing for hinged door movement and sealing against the entry of dirt and water.

5 Claims, 3 Drawing Sheets

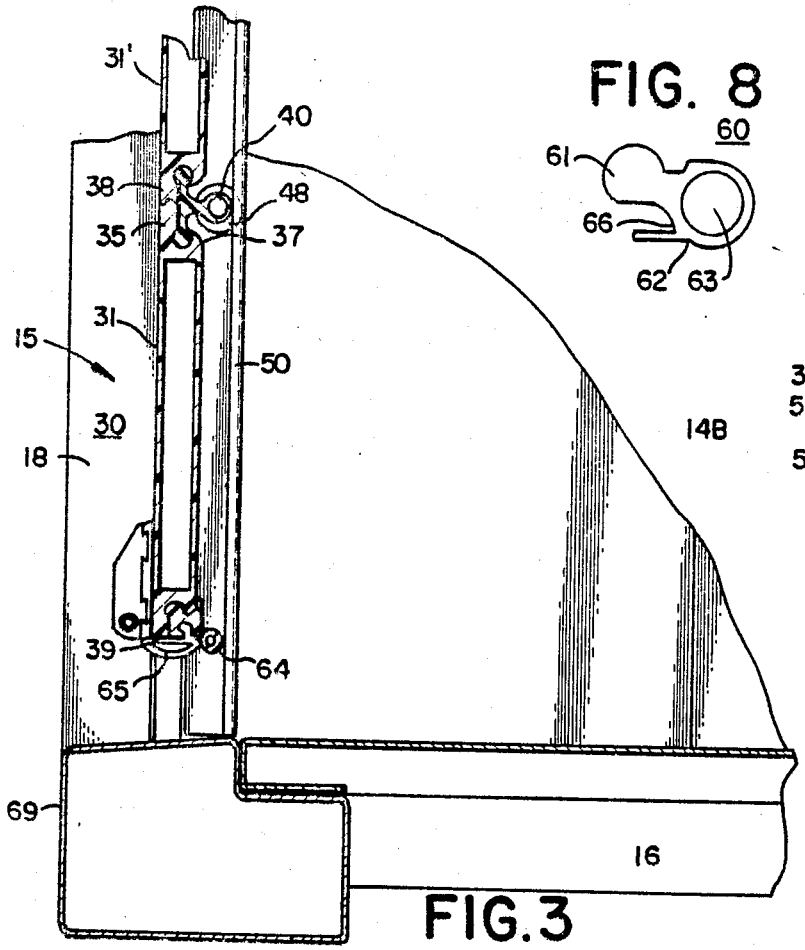
FIG. 3
FIG. 8
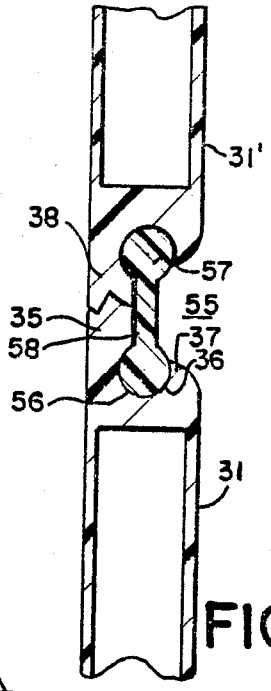
FIG.4
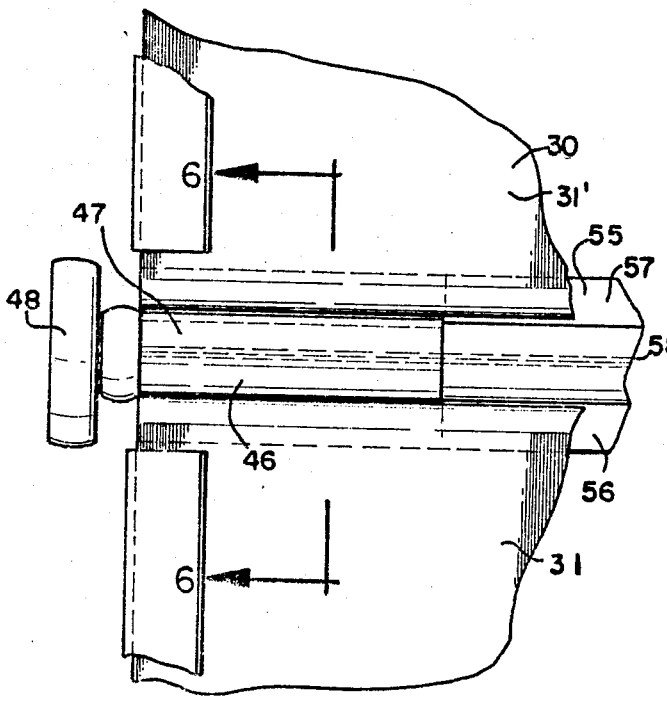
FIG. 5
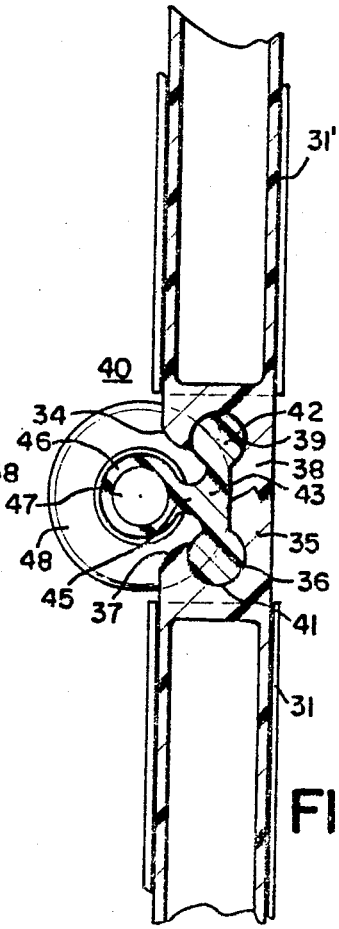
FIG.6

DOOR AND HINGE CONSTRUCTION FOR OVERHEAD DOORS

This is a continuation of application Ser. No. 824,417, filed Jan. 31, 1986, now abandoned.

BACKGROUND OF THE INVENTION

1. Field of the Invention

This invention relates to a door and hinge construction of the type used with sliding overhead door panels, which panels are mounted between and move vertically in roller tracks.

2. Description of the Prior Art

Overhead doors have been in use for many years, are often used with truck and van bodies, and offer many advantages over swinging doors. Overhead doors can be of lighter weight, and becuase they move vertically up out of the way, do not reduce useful space, and do not require sidewise clearance for opening and closing as is necessary for side mounted swinging doors. Overhead door constructions in use typically involve a plurality of panels hinged together by strap hinges which are bolted through the panels, with strap hinges at the panel ends carrying rollers which are carried in tracks that extend along the sides and up under the roof of the supporting structure, such as a truck or van body.

Bolting through the panels is unsatisfactory as it weakens and panels, offers points at which the weather can enter and deteriorate the panels, as well as providing an uneven surface which reduces the area for decal application, and requires a solid heavy panel construction to support the bolts. Such door panels are usually provided at their meeting edges with some type of interlocking arrangement, in order to seal the interior of the structure on which they are mounted, but most such structure are often unsatisfactory as they leak and suffer from other problems. The door and hinge construction of the invention does not suffer from the problems of the prior art and offers many positive advantages.

SUMMARY OF THE INVENTION

In accordance with the invention, a door and hinge construction for overhead doors is provided which comprises a plurality of door panels hingedly connected together at the ends by combination hinge and roller housings, and between the housings by hinge and seal members, with rollers engaged in the housings, which are carried in vertical tracks at the ends of the panels.

The principal object of the invention is to provide a door and hinge construction for overhead doors that provides positive sealing as well as smooth operation.

A further object of the invention is to provide a door and hinge construction as aforesaid wherein the door panels are of lighter weight than panels previously utilized.

A further object of the invention is to provide a door and hinge construction as aforesaid which reduces the number of fasteners required and reduces deterioration of the door panels.

A further object of the invention is to provide a door and hinge construction as aforesaid which results in reductions in cost for inventory, manufacturing and assembly.

A further object of the invention is to provide a door and hinge construction as aforesaid which has a wide variety of applications.

Other objects and advantageous features of the invention will be apparent from the description and claims.

DESCRIPTION OF THE DRAWINGS

The nature and characteristics features of the invention will be more readily understood from the following description taken in connection with the accompanying drawings forming part hereof in which:

FIG. 3 is a fragmentary, vertical, sectional view, enlarged, taken approximately on the line 3—3 of FIG. 1;

FIG. 4 is a fragmentary, vertical, sectional view, enlarged, taken approximately on the line 4—4 of FIG. 1;

FIG. 5 is a fragmentary, vertical, sectional view of a portion of the door and hinge construction of the invention;

FIG. 6 is a fragmentary, vertical, sectional view taken approximately on the line 6—6 of FIG. 5;

FIG. 8 is a fragmentary end elevational view, of a portion of the structure of the invention taken at location 8 on FIG. 3.

Figure 1:
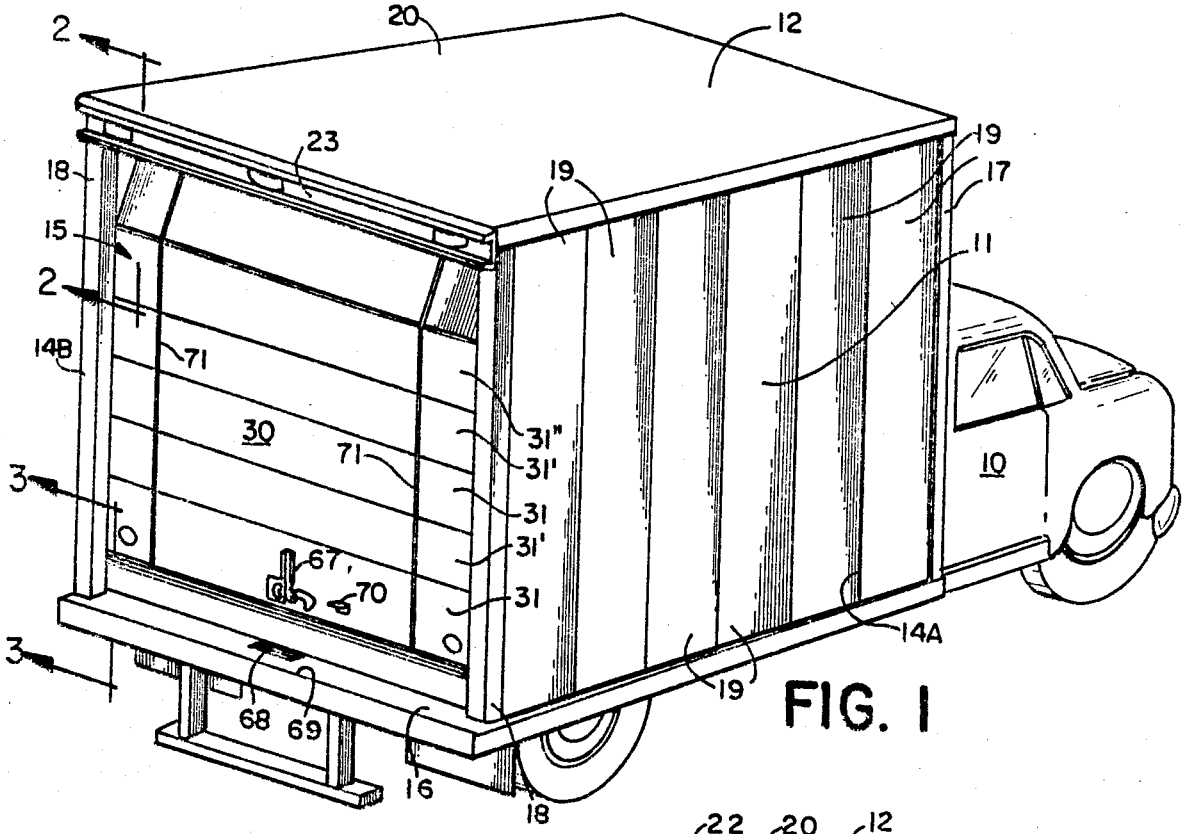
FIG. 1 is a view in perspective of a typical truck carrying a van body, which illustrates the door and hinge construction of the invention as installed.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings and FIGS. 1 to 8, inclusive, a truck 10 of conventional well known type is illustrated which has a body 11 thereon of generally rectangular configuration with a roof 12, sides 14A and 14B, and is open at the rear 15. The body 11 as illustrated is of well known type with a bed or floor 16, which has pairs of front and rear corner posts 17 and 18 engaged therewith, with vertical panels 19 engaged with the extending above the bed 16 to the roof 12, and between posts 17 and 18.

The roof 12 may be formed of top and bottom panels 20 and 21 with transversely extending I beams 22 connecting the sides 14A and 14B. The roof 12 at the rear portion thereof may be provided with a transverse drip channel 23 which is connected to the roof 12 and rear corner posts 18.

The body 11 at the rear 15 has an overhead door 30 therein, which door 30 includes a plurality of rectangular door panels 31 which may be hollow in the center and filled with a honeycomb material (not shown) which can be of any well known type with a polyvinylchloride/urethane honeycomb being preferred.

The door panels 31 can be molded of fibreglas or other suitable materials as desired, and as illustrated are approximately 15 inches high and 90 inches wide.

Referring more particularly to FIGS. 3, 4 and 6, portions of two door panels 31 and 31′ are illustrated, the bottom most panel 31 having an upwardly extending notched rail 35 on the outside of the panel 31 with a cylindrical groove 36 extending lengthwise across panel 31 end to end, and with a rounded cut back portion 37 adjacent the groove 36. The panel 31′ adjacent to and above panel 31, has a complimentary downwardly extending notched rail 38, which can engage rail 35 to provide a tight joint. The panel 31′ inside of rail 38 has a groove 39 similar to groove 36, and which extends lengthwise across panel 31′ end to end, and with a rounded cut back portion 34 adjacent to groove 39.

At each end of panels 31 and 31′ combination hinge and roller housings 40 are provided, preferably molded of synthetic plastic with delrin being preferred, which housings each have semi-cylindrical ribs 41 and 42 engaged respectively in grooves 36 and 39 of panels 31 and 31′ which ribs are connected by a center plate 43. The combination hinge and roller housings 40 are provided with a sleeve 45 connected to plate 43 on the side opposite to rails 35 and 38, which sleeve has a bore 46 with a pin 47 engaged therewith, which pin 47 has a roller 48 rotatably mounted thereto outside of the ends of the panels 31, 31′.

The rollers 48 are engaged with a vertical rail 50 which is fastened to a rear corner post 18, the rail extends upwards, curves and extends under roof 12, to which it is fastened by brackets 51 of well known type.

The combination hinge and roller housings 40 extend along grooves 36 and 39 a distance of approximately 2 inches. The grooves 36 and 39 between the combination hinge and roller housings 40 at the end of panels 31, 31′ have seal members 55 engaged therewith, which seal members 55 include ribs 56 and 57 engaged with the grooves 36 and 39 and connected by a center plate 58. The seal members 55 can be formed of any suitable material, such as synthetic plastic, with molded polyvinylchloride or urethane being preferred.

The panel 31, as shown more clearly in FIGS. 3 and 8, is also provided with a bottom roller housing 60, which can also be of molded plastic, and with a rib 61 engaged in the groove 39 in the panel 31. The rib 61 has a sleeve 62 extending therefrom which has a pin 63 therein rotatably mounting a roller 64, the roller 64 being carried in rail 50. A molded bottom seal 65 is provided, of well known type, and engaged in channel 66 of housing 60 and effective to seal the interior of body 11 when it is in contact with bed 16. The bottom door panel 41 is also provided with a latching assembly 67 of well known type which can be engaged in a recess 68 of a sill plate 69 at the rear of bed 16 to lock and restrain the door 30 from upward movement. The bottom panel 31 is additionally provided with a handle 70 for ease in raising and lowering the door 30. The bottom panel 31 adjacent its ends can have cables 71 engaged therewith which extend upwardly to rollers 72 mounted by brackets 73 to corner posts 18 and which can be spring loaded (not shown) to reduce the effort required in lifting door 30.

Figure 2:
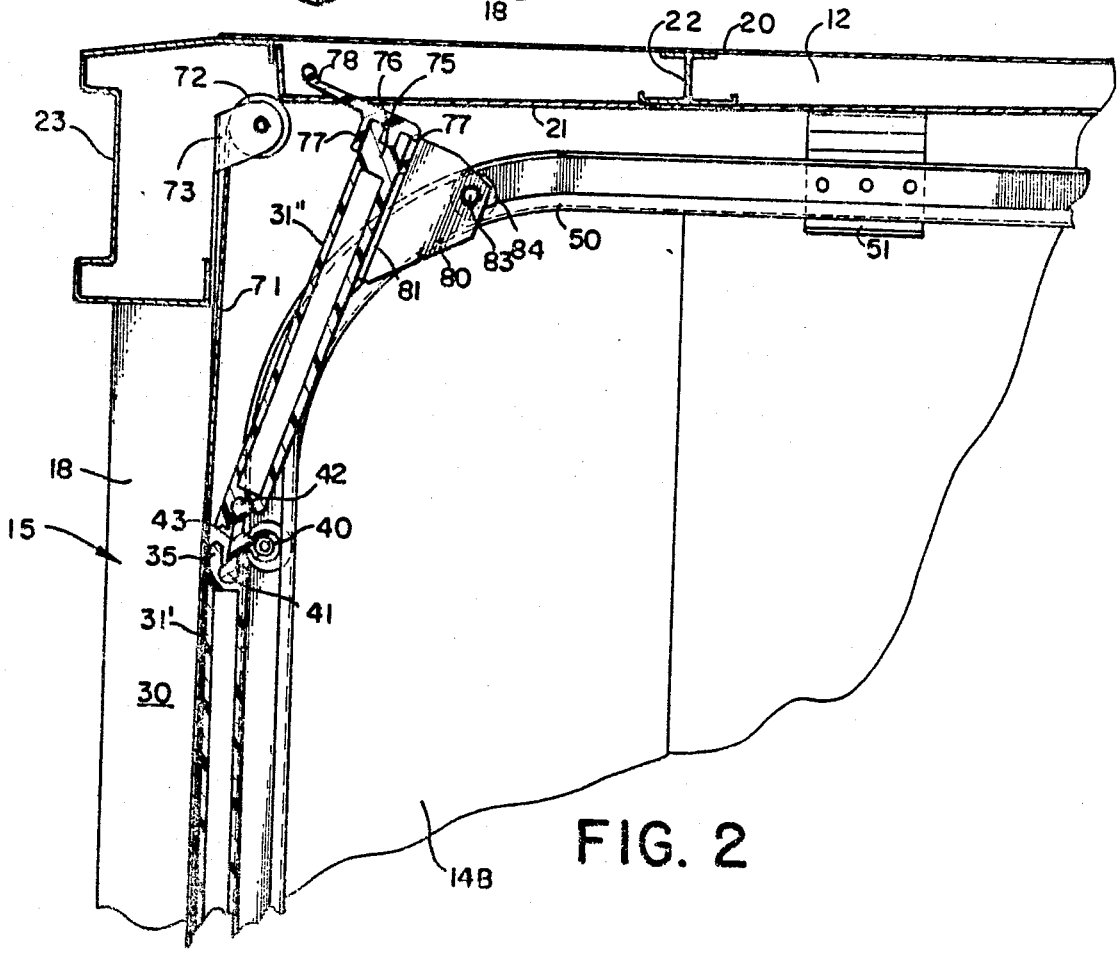
FIG. 2 is a fragmentary, vertical, sectional view, enlarged, taken approximately on the line 2—2 of FIG. 1.
Figure 7:
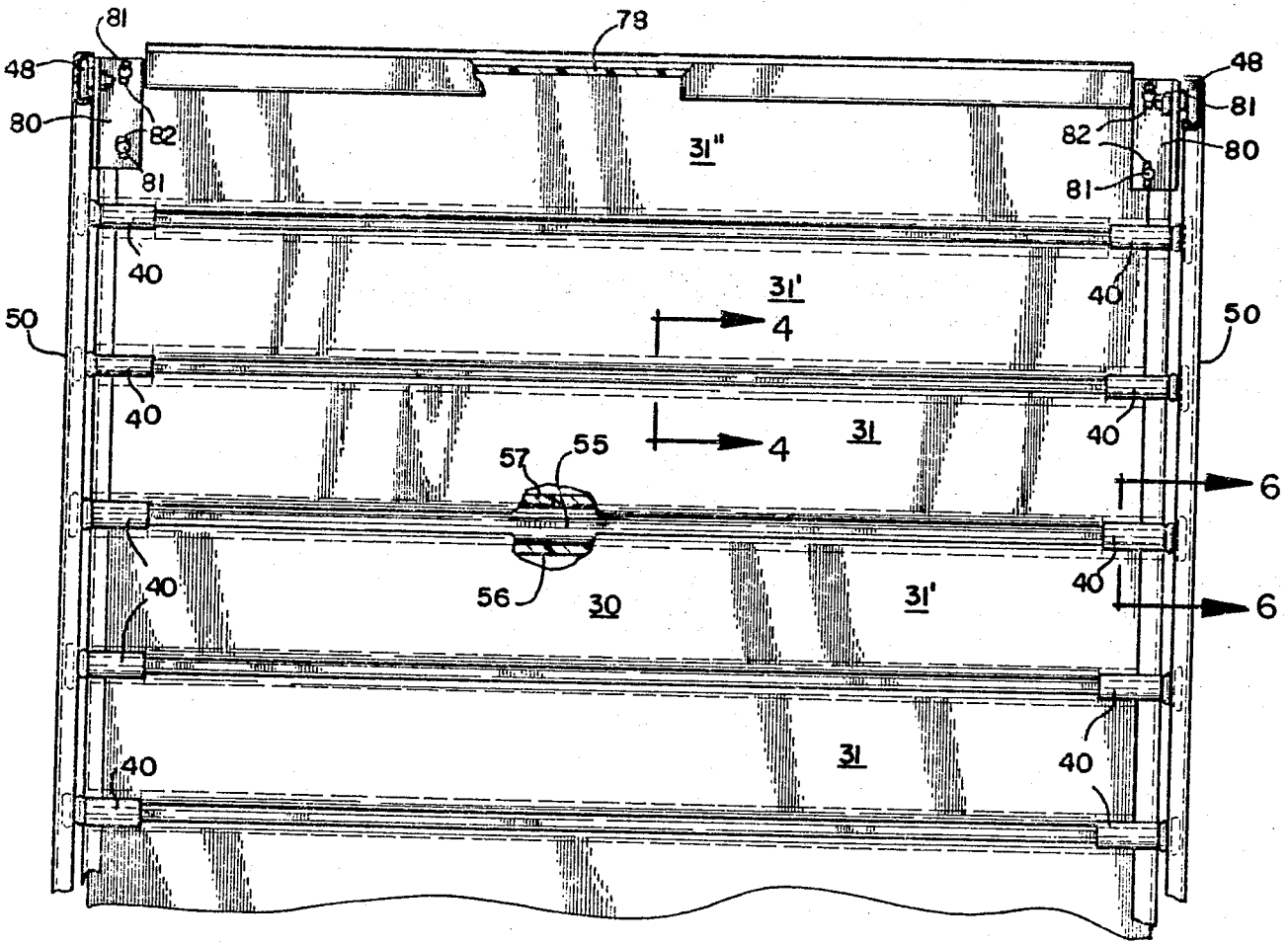
FIG. 7 is a rear elevational view from the inside of the truck body, partially broken away to show the internal construction, of a portion of the door and hinge construction of FIG. 1.

The top most door panel 31″, as shown more particularly in FIG. 2, is of the same overall configuration as door panel 31′ except that the uppermost edge 75 is U-shaped with a rigid polyvinylchloride seal strip 76 engaged therewith, which has U-shaped fingers 77 to engage the panel 31″ and with a rearwardly extending finger 78 for engagement with channel 23 when the door 30 is in the down or locked position.

The panel 31″ has an adjusting bracket 80 at each end engaged therewith and secured to the panel 31″ by bolts 81 in slots 82 permitting limited movement to adjust the position of panel 31″ for best operation and sealing. The bracket 80 has a pin 83 carried therein with a roller 84 rotatably attached thereto and engaged with the rail 50.

The mode of operation and use is apparent from the foregoing description.

It will thus be seen that a door and hinge construction has been provided which accomplishes the objects of the invention.

I claim:

1. A door hinge construction for a sliding overhead door, said door being intended to be carried in tracks at the sides thereof which comprises:

a plurality of stacked door panels in transverse meeting relationship and carried between said tracks;

said door panels having top and bottom edges, and side edges;

said door panel top edges having an upwardly extending rail including a first transverse groove therein;

said door panel bottom edges having a downwardly extending rail including a second transverse groove therein;

said upwardly extending and said downwardly extending rails of adjacent door panels being of complementary configuration;

seal means between adjacent panels engaged in said first and second transverse grooves, said seal means including first and second ribs carried in said first and second transverse grooves and a centerplate connecting said ribs, to provide thereby a hinge, and also retaining said panels in close relationship;

readily removable combination hinge and roller housing means between and in engagement with adjacent door panels, said hinge and roller housing means including first and second ribs carried in said first and second transverse grooves, said hinge and roller housing means being separated and independent from said seal means by being independently disengageable from said adjacent door panels by removing the first and second ribs of the hinge and roller housing means from the first and second transverse grooves;

said roller housing means including roller means for insertion in tracks at the sides of said door, said roller means being at said side edges of said door panels, wherein said readily removable combination hinge and roller housing means comprises:

a plate connecting said ribs of said roller housing means;

an offset sleeve extending rearwardly and outwardly from said door panels, said sleeve having a bore therein, said bore extending outwardly from said door panels;

a pin in said bore; and said roller means carried by and being rotatable about said pin, whereby said roller means are disposed rearwardly and outwardly from said door panels.

2. A door and hinge construction as defined in claim 1 in which said seal means are of molded plastic.

3. A door and hinge construction for a sliding overhead door, said door being intended to be carried in tracks at the sides thereof which comprises:

a plurality of stacked door panels in having top, bottom and side edges;

said door panel top edges having an upwardly extending rail including a first transverse groove therein;

said door panel bottom edges having a downwardly extending rail including a second transverse groove therein;

seal means between adjacent panels engaged in said first and second transverse grooves, said seal means including first and second ribs carried in said first and second transverse grooves and a center plate connecting said ribs, to provide thereby a hinge, and also retaining said panels in close relationship;

readily removable combination hinge and roller housing means between and in engagement with adjacent door panels, said hinge and roller housing means including first and second ribs carried in said first and second transverse grooves, said hinge and roller housing means being separate and independent from said seal means by being independently disengageable from said adjacent door panels by removing the first and second ribs of the hinge and roller housing means from the first and second transverse grooves;

said roller housing means having an offset portion extending rearwardly and outwardly from said door panels;

and roller means rotatably supported in said roller housing means for insertion in tracks at the sides of said door.

4. A door and hinge construction as defined in claim 3 in which said top edge rail configuration includes a notch; and said bottom edge rail configuration includes a notch complementary to said top edge rail notch whereby engagement therebetween provides a tight joint.

5. The door and hinge construction for a sliding door as defined in claim 3 in which said uppermost door panel is provided with a seal means in said uppermost transverse edge groove, said uppermost door panel having adjusting brackets fastened thereto; and said brackets each having roller means engaged in said tracks.

* * * * *